US008015619B2

(12) United States Patent
McKay et al.

(10) Patent No.: US 8,015,619 B2
(45) Date of Patent: Sep. 13, 2011

(54) RAPID EXTRACTION BODY HARNESS WITH EXTENDABLE DRAG STRAPS

(75) Inventors: Sean McKay, Greenville, SC (US); David E. O'Neal, Akron, OH (US); Arthur L. Dobbins, Akron, OH (US)

(73) Assignee: North American Rescue, LLC, Greer, SC (US)

( * ) Notice: Subject to any disclaimer, the term of this patent is extended or adjusted under 35 U.S.C. 154(b) by 456 days.

(21) Appl. No.: 12/286,370

(22) Filed: Sep. 30, 2008

(65) Prior Publication Data

US 2009/0200106 A1 Aug. 13, 2009

Related U.S. Application Data

(63) Continuation-in-part of application No. 11/391,043, filed on Mar. 28, 2006, now Pat. No. 7,467,419.

(60) Provisional application No. 60/667,651, filed on Apr. 4, 2005, provisional application No. 60/997,227, filed on Oct. 2, 2007.

(51) Int. Cl.
*A41D 13/00* (2006.01)

(52) U.S. Cl. ..... 2/69

(58) Field of Classification Search ..... 2/69, 79, 2/81, 227, 94, 97, 69.5, 456, 310; 182/3–7; 244/151 R See application file for complete search history.

(56) References Cited

U.S. PATENT DOCUMENTS

| | | | | |
|---|---|---|---|---|
| 153,724 | A | 7/1874 | Schmidt | |
| 2,699,284 | A * | 1/1955 | Rose | 182/3 |
| 3,034,596 | A | 5/1962 | Twaits, Jr. | |
| 3,074,074 | A | 1/1963 | Lovering | |
| 3,322,102 | A | 5/1967 | Windle | |
| 4,298,091 | A | 11/1981 | Anderson | |
| 4,854,418 | A * | 8/1989 | Hengstenberger et al. | 182/3 |
| 4,863,409 | A | 9/1989 | Johnson et al. | |
| 4,925,070 | A | 5/1990 | Tulgan | |
| 5,113,981 | A | 5/1992 | Lantz | |
| 5,279,386 | A | 1/1994 | Cearley | |
| 5,345,947 | A | 9/1994 | Fisher | |
| 5,351,654 | A | 10/1994 | Fuentes | |
| 5,388,551 | A * | 2/1995 | Martusciello | 119/770 |
| 5,435,272 | A | 7/1995 | Epstein | |
| 5,619,955 | A * | 4/1997 | Nelson | 119/857 |
| 5,718,189 | A | 2/1998 | Blake | |
| 5,732,662 | A | 3/1998 | Jacobsen | |
| 5,787,500 | A | 8/1998 | Lobello | |
| 5,842,444 | A | 12/1998 | Perrulli | |
| 5,960,480 | A | 10/1999 | Neustater et al. | |
| 5,971,668 | A | 10/1999 | Miller | |

(Continued)

*Primary Examiner* — Tejash Patel
(74) *Attorney, Agent, or Firm* — McNair Law Firm, P.A.; Seann P. Lahey

(57) ABSTRACT

A body harness having an adjustable waist strap; a shoulder strap having a first distal end affixed to a right side of said waist strap and a second distal end affixed to a left side of said waist strap generally opposite from said first distal end so that said shoulder strap is carried by said waist strap in a looping arrangement; a back strap affixed between said waist strap and shoulder strap, wherein said back strap extends approximately between a midpoint of said waist strap and a midpoint of said shoulder strap for supporting the back of the user when being dragged; an elongated drag strap carried by said back strap and disposed generally at the intersection of said back strap and said shoulder strap for extending to facilitate dragging of the user; and, a hand grip carried by said drag strap for increased grip.

18 Claims, 5 Drawing Sheets

U.S. PATENT DOCUMENTS

| | | | | |
|---|---|---|---|---|
| 6,050,869 | A | 4/2000 | Kellett | |
| 6,125,792 | A | 10/2000 | Gee | |
| 6,205,584 | B1 | 3/2001 | Yocco | |
| 6,256,789 | B1 | 7/2001 | Young et al. | |
| 6,305,024 | B1 | 10/2001 | Schweer | |
| 6,338,699 | B1 | 1/2002 | Veitch | |
| D454,235 | S | 3/2002 | Kaplan | |
| 6,637,547 | B1 | 10/2003 | Wydner | |
| 6,651,594 | B1 | 11/2003 | Bagwell | |
| 6,658,666 | B2 * | 12/2003 | Schweer | 2/94 |
| 6,675,742 | B1 | 1/2004 | Shiraki | |
| 6,808,046 | B1 | 10/2004 | Henson | |
| 6,827,045 | B1 | 12/2004 | Willner et al. | |
| 6,851,393 | B2 | 2/2005 | Bremm | |
| 6,871,368 | B2 | 3/2005 | Calkin | |
| 6,892,395 | B2 | 5/2005 | Schweer | |
| D509,329 | S | 9/2005 | Willner et al. | |
| 6,968,809 | B2 | 11/2005 | Reardon | |
| 6,990,928 | B2 | 1/2006 | Kurtgis | |
| 7,025,172 | B2 | 4/2006 | Gregory | |
| 7,086,091 | B2 | 8/2006 | Jordan | |
| D539,489 | S | 3/2007 | Scott | |
| 7,188,585 | B1 | 3/2007 | Carter | |
| 7,467,419 | B2 * | 12/2008 | O'Neal et al. | 2/69 |
| 2004/0182644 | A1 | 9/2004 | Kotarski | |
| 2005/0211188 | A1 | 9/2005 | Grilliot et al. | |
| 2006/0070800 | A1 | 4/2006 | Lewis et al. | |
| 2007/0044197 | A1 | 3/2007 | Turcotte et al. | |
| 2007/0084667 | A1 | 4/2007 | Waters et al. | |
| 2007/0169246 | A1 | 7/2007 | Sloan et al. | |
| 2007/0192926 | A1 | 8/2007 | Fee et al. | |
| 2008/0184488 | A1 | 8/2008 | Fee et al. | |
| 2008/0289086 | A1 | 11/2008 | Grilliot et al. | |

* cited by examiner

RAPID EXTRACTION BODY HARNESS WITH EXTENDABLE DRAG STRAPS

CROSS REFERENCE TO RELATED APPLICATIONS

This application is a continuation-in-part of U.S. patent application Ser. No. 11/391,043, filed Mar. 28, 2006 now U.S. Pat. No. 7,467,419, which claims the benefits of the filing date of U.S. Provisional Patent Application Ser. No. 60/667,651, filed Apr. 4, 2005. This application also claims the benefits of the filing date of U.S. Provisional Patent Application Ser. No. 60/997,227, filed Oct. 2, 2007.

BACKGROUND OF THE INVENTION

1) Field of the Invention

The present invention relates to safety and rescue of downed or injured law enforcement, military or tactical operations personnel from a hostile environment, and more particularly, to a body harness for dragging an injured person out of danger without displacing other protective gear worn by the injured person.

2) Description of Related Art

Today, law enforcement and military personnel face more challenges than ever and the threats are increasingly more dangerous. Rescuers working to remove injured personnel in a hostile combat environment also face many challenges. Traditional methods of removing an injured person typically require three to four people on average to grab various the injured person anyway they can and drag them to safety. These methods are extremely time consuming, overly strenuous, unreliable, and extremely dangerous for several reasons. First, grabbing the protective vest or other gear of the injured person to drag them to safety can make it difficult to obtain sufficient leverage for moving quickly. Also, it is difficult to obtain a good grip and the section being grabbed may fail from the weight when the person is being dragged. Further, dragging the injured person by their protective gear causes the gear to slide up on the injured person and unnecessarily exposes them to further injury. Also, currently methods create unnecessarily longer exposure times for the rescuers, subjecting both the rescuers and injured person to continued hostile fire. Further, current extraction methods tend to cause the rescuer to disengaged from the enemy when attempting to grab the injured person, leading to potentially deadly results.

In short, prior methods of rapid extraction took more people, more time, and left the rescuer(s) and injured person exposed to the threat for longer periods of time. Accordingly, a need was realized for more efficient ways to remove injured personnel that is quick, reliable, and limits dangerous exposure of the rescuers and the injured person during extraction.

Thus, it is an object of the present invention to provide a rapid extraction body harness which not only reduces the number of people required to drag a person to safety, but also the amount of time and effort needed to do so.

It is a further object of the present invention to provide a body harness that can be worn under the user's other protective gear and will slide under the protective gear so that when being dragged the user's other protective gear is not moved out of place.

It is a further object of the present invention to provide a body harness that allows a rescue to drag the user to a safe location without having to disengage his weapon from the enemy.

SUMMARY OF THE INVENTION

The above objectives are accomplished according to the present invention by providing a body harness for dragging a person from a hostile environment, the harness comprising an adjustable waist strap; a shoulder strap having a first distal end affixed to a right side of the waist strap and a second distal end affixed to a left side of the waist strap generally opposite from the first distal end so that the shoulder strap is carried by the waist strap in a looping arrangement; a back strap affixed between the waist strap and shoulder strap, wherein the back strap extends approximately between a midpoint of the waist strap and a midpoint of the shoulder strap for supporting the back of the user when being dragged; an elongated drag strap carried by the back strap and disposed generally at the intersection of the back strap and the shoulder strap for extending to facilitate dragging of the user; and, a hand grip carried by the drag strap for increased grip.

In a further advantageous embodiment, the harness includes a first elongated drag strap and a second elongated drag strap carried adjacent each other on the back strap, wherein each of the drag straps includes a hand grip. In a preferred embodiment, widths of each the first and second drag straps are approximately half the width of the back strap.

In a further advantageous embodiment, the back strap includes a first strap layer and a second strap layer arranged in an overlapping manner so that the waist strap is disposed between the first and second strap layers generally at a first distal end of the back strap, and the elongated drag strap is secured between the first and second layers generally at a second distal end of the back strap.

In a further advantageous embodiment, the elongated drag strap is constructed and arranged in a loop so that a first distal end and a second distal end of the drag strap are secured between the first and second layers of the back strap.

In a further advantageous embodiment, the hand grip includes a hollow generally cylindrical shape, and wherein the elongated drag strap extends through the hand grip.

In a further advantageous embodiment, a securing flap is carried by the back strap having a free end operable between an engaged condition secured against the back strap holding the hand grip and the elongated drag strap in a stored position generally adjacent the intersection of the back strap and the shoulder strap, and the securing flap having a released condition wherein the free end is disengaged from the back strap allowing the drag strap and hand grip to extend to a deployed position. In a preferred embodiment, the harness includes a quick-release connector coupling the free end of the securing flap to the back strap so that the securing flap may be rapidly released for deploying the elongated drag strap.

In a further advantageous embodiment, the securing flap is integrally formed from an extension of the back strap adjacent the intersection of the shoulder strap and the back strap.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
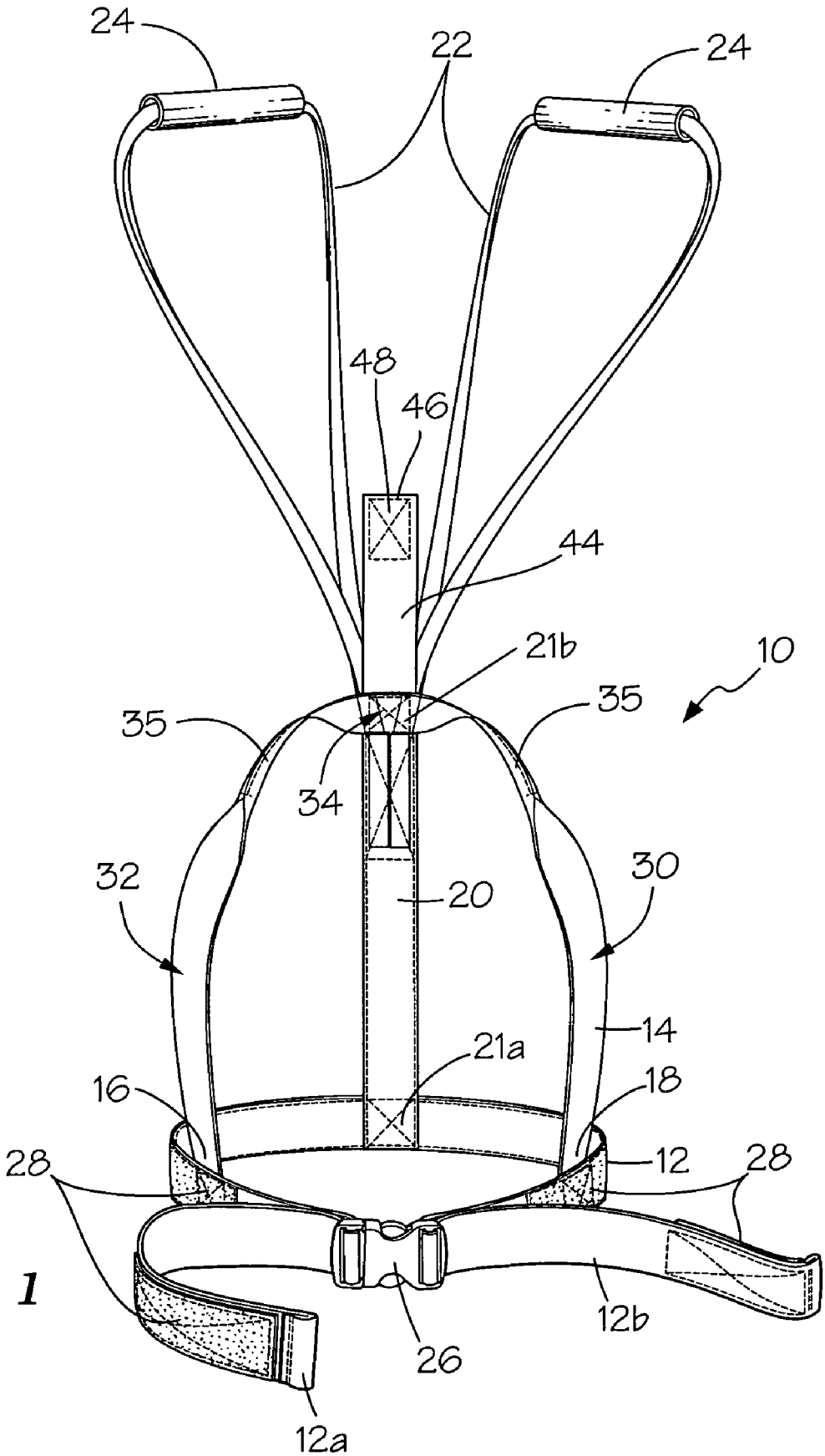
FIG. 1 shows a perspective view of the body harness according to the present invention.
Figure 2:
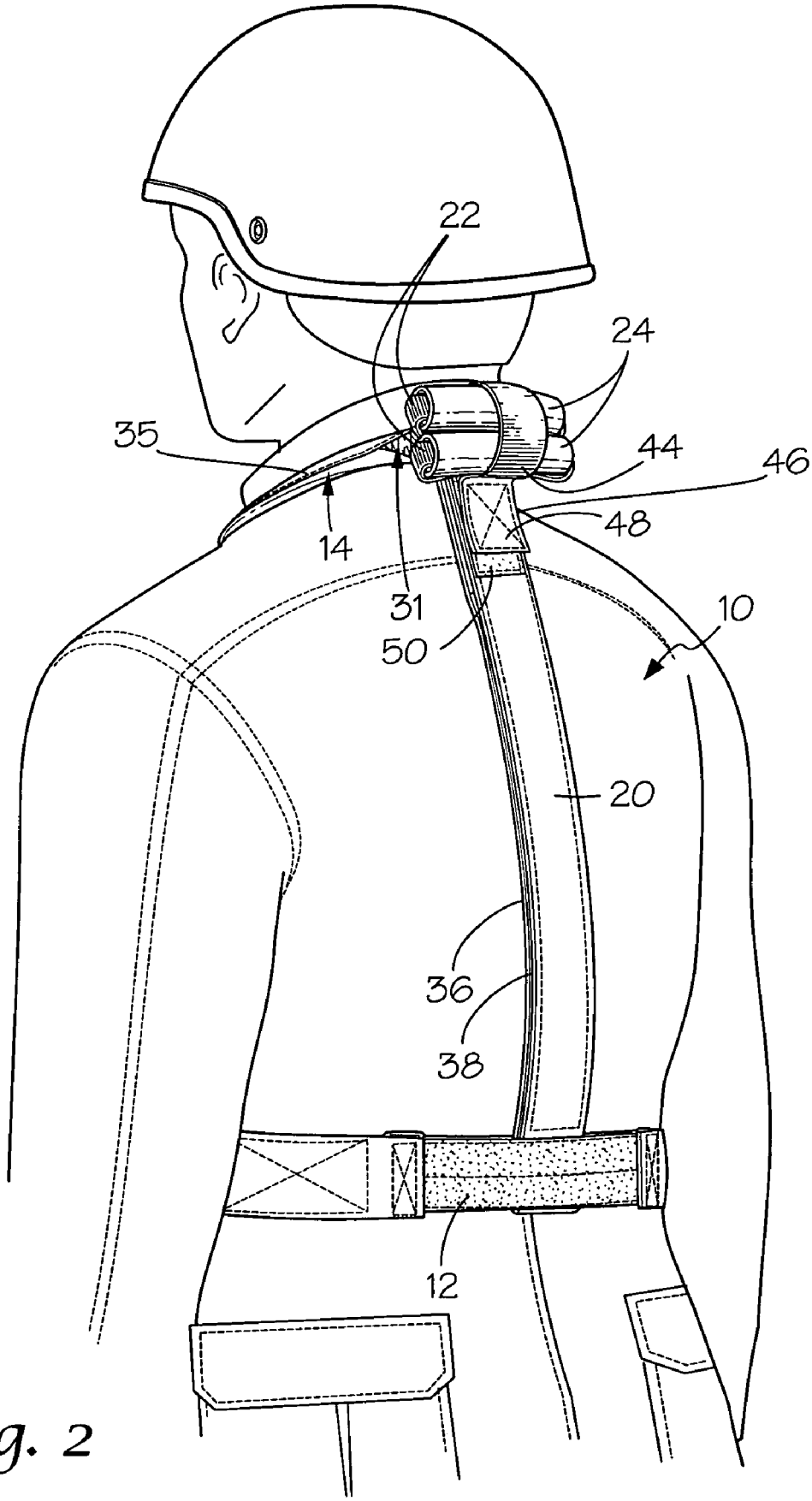
FIG. 2 shows a perspective rear view the body harness in position on a user according to the present invention.
Figure 4:
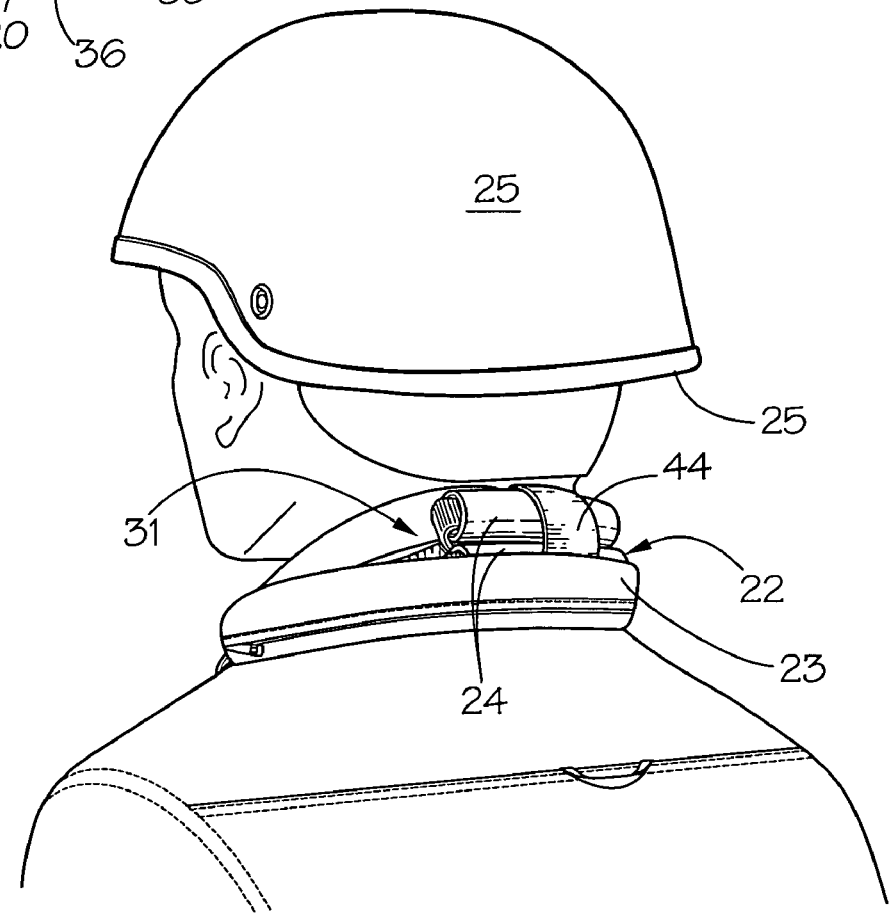
FIG. 4 shows a perspective close-up view of drag strap handles exposed behind a user's neck with wearing exterior protective gear according to the present invention; and, FIGS. 5A, 5B and 5C shows a rescuer deploying the drag strap handles to drag an injured person to safety while maintaining engagement with an enemy according to the present invention.

With reference to the drawings, the invention will now be described in more detail. Referring to FIG. 1, a body harness, designated generally as 10, is shown which is intended for use in allowing a single rescuer to drag an injured person from a hostile environment. As shown in FIG. 4, body harness 10 is designed to be worn under a tactical vest or other similar types of protective gear for dragging the user, but with drag handles 22 exposed behind the user's neck to quick and easy access by a rescuer. Drag harness 10 is specifically constructed and arranged to locate drag handles 24 at a location above a collar 23 as found on must tactical combat protective vests, but below a bottom edge 25 of a typical combat helmet. Referring to FIG. 2, it may however, be positioned over the exterior of other protective gear, but is preferred to be worn underneath such protective gear. It is lightweight, flexible, comfortable and extremely strong. A further notable feature of the present invention is that use of this body harness does not require any modification to existing gear commonly worn by tactical military and law enforcement personnel. In use, it slides under the protective gear allowing the protective gear to remain in place when the injured user is being dragged, thus avoiding potentially lethal exposure of the abdominal region and lower back by eliminating "ride up" of the injured persons bulletproof vest.

Figure 3:
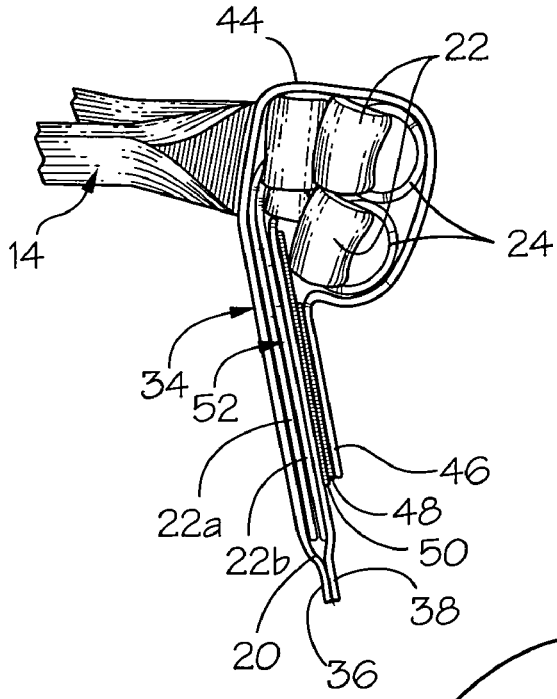
FIG. 3 shows a detailed side view of the drag straps in an stored position according to the present invention.

Referring to FIG. 1, body harness 10 includes an adjustable waist strap 12 for wrapping around the torso of the wearer. A shoulder strap 14 is provided having a first distal end 16 affixed to a right side of waist strap 12 and a second distal end 18 affixed to a left side of waist strap 12. The distal ends 16 and 18 are located generally opposite from each other along waist strap 12 when worn by the user so that shoulder strap 14 is carried by waist strap 12 in a looping arrangement. A back strap 20 is provided that is affixed between waist strap 12 and shoulder strap 14, wherein back strap 20 extends approximately between a midpoint 21*a* of waist strap 12 and a midpoint 21*b* of shoulder strap 14 for supporting the back of the user when being dragged. Referring to FIGS. 1 and 3, a pair of elongated drag straps 22 are carried by back strap 20 and disposed generally at the intersection 21*b* of back strap 20 and shoulder strap 14 for extending to facilitate dragging of the user. Also, a hand grip 24 is preferably carried by each of drag straps for increased grip. Handle 20 is preferably a flexible but durable material so that if a user falls on his neck the handles will not cause injury. Thus it is recommended that rigid plastic handles be avoided, although such handles may be used and are within the scope of the invention.

Referring to FIGS. 2 and 4, the built-in extendable drag handles 22 with hand grips 24 are positioned for easy accessibility behind the user's neck, designated generally as 31, allowing immediate high threat extraction of downed personnel without the need to holster or sling weapons during rescue to find a place to grab the injured person. This enables more fire power on the threat while the inline drag reduces the risks of back injury, provides more leverage for dragging, and reduces the profile of the person being dragged by moving them horizontally.

Referring to FIG. 1, the construction of waist strap 12, shoulder strap 14 and back strap 20 is preferably of durable 2" flat nylon webbing of the automotive seatbelt type construction (typically rated at over 3000 lbs.). Deployable drag straps 22 are preferably constructed of low profile 1" "Tech Tape". Preferably, the harness features box-stitching on all seams and intersections, such as 16, 18, 21*a* and 21*b*, and an adjustable buckle 26 at the abdomen. On waist strap 12 you will find buckle 26 used to secure the lower portion of drag harness 10 to the wearer. Preferably, waist strap 12 is connected at opposing distal ends with an ITW Nexus buckle, or similar heavy load quick-connect device.

Referring to FIGS. 1 and 2, in operation, the wearer puts harness 10 on like a coat, snaps quick-release buckle 26 together in the front, and adjusts waist strap 12 by pulling extra length portions 12*a* and 12*b* to synch the strap tight. Waist strap includes cooperating hook and loop connectors 28, such as Velcro®, to secure excess waist strap portions 12*a* and 12*b* back onto itself.

Figure 5A:
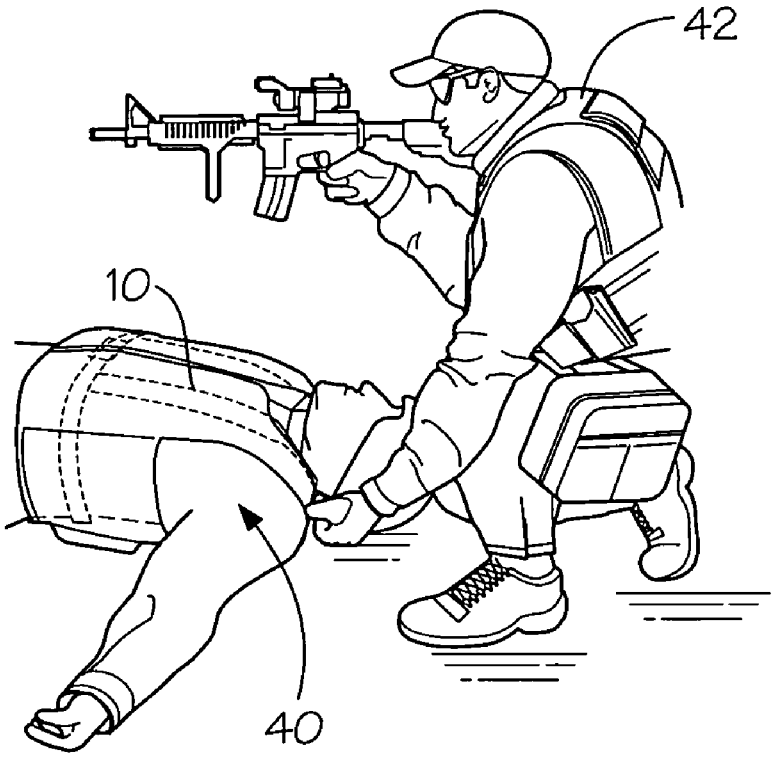
Figure 5B:
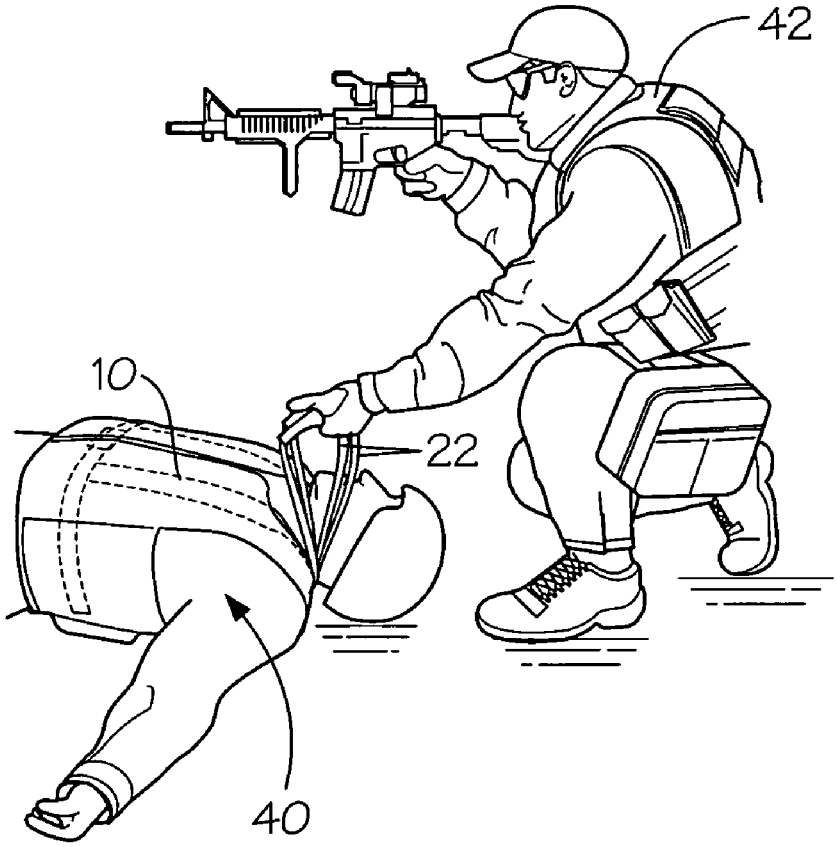
Figure 5C:
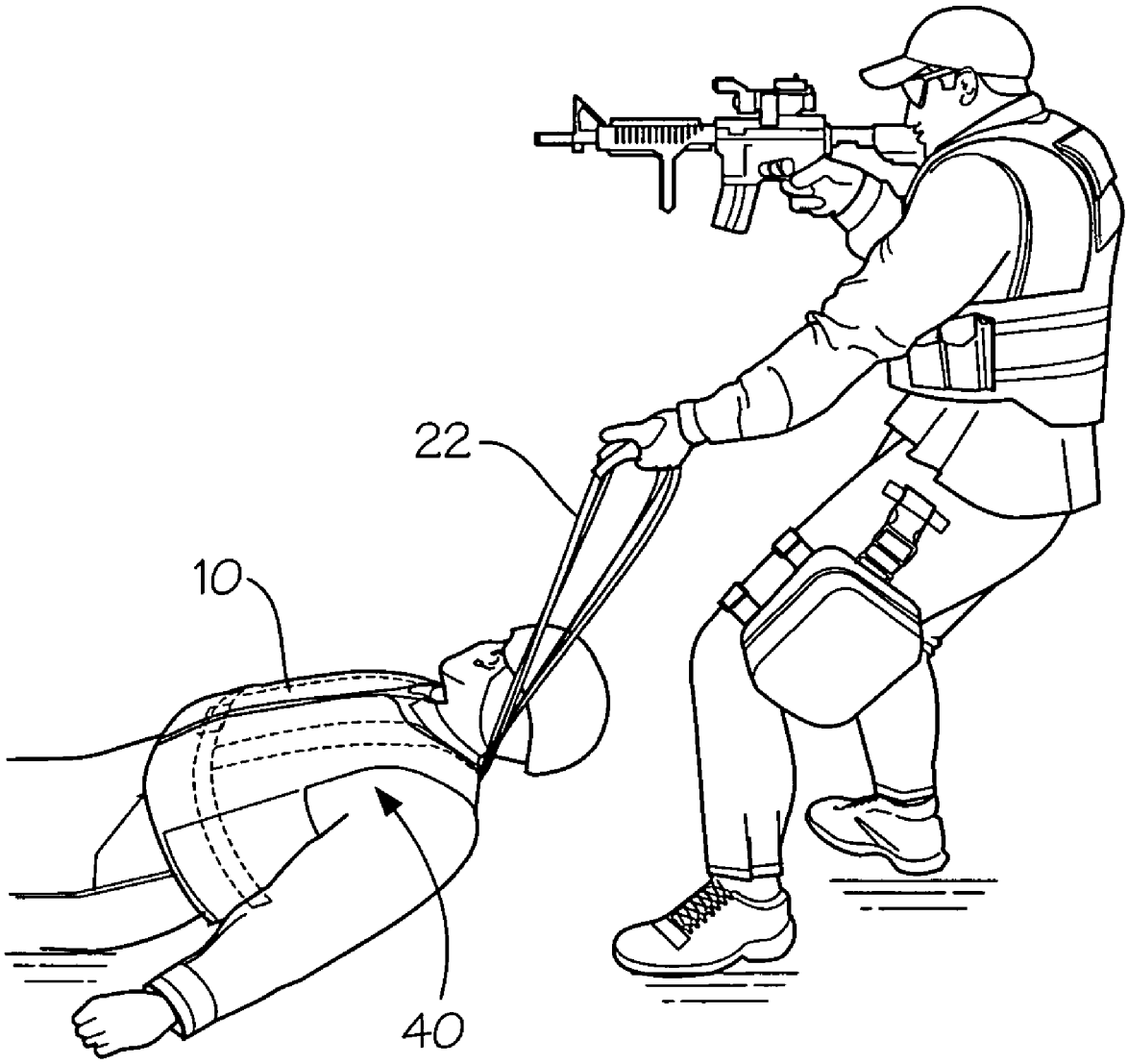

Referring to FIGS. 5A-5C, in the event the wearer 40 becomes injured or incapacitated, body harness 10, shown in dotted lines beneath a protective vest, will assist in their removal to a safe location. A rescuer 42 simply grabs drag strap hand grips 24 behind the wearer's neck and pulls to extend the drag straps to provide leverage for dragging the injured wearer. Rescuer 42 can maintain his weapon in engagement with the enemy during this process and need not spend time looking a the injured person for a place to grab them. The harness will likely slide up the wearer and grab the wearer in the area around the upper chest and just below the armpits. The harness provides leverage to the rescuer, making it possible for as few as one person to move the injured person by dragging. Rescuer 42 can pull with one hand and provide protection for both he and the injured person with the other, since the rescuer will not need to holster his weapon or disengage his view from the threat to perform the rescue drag. Traditionally, this would be a three or four person operation, with two people carrying and one or two people providing cover, thus exposing four or five people to further danger. It is important to mention that harness 10 is designed for horizontal evacuations only. The harness is not designed, nor was there intent for the harness to be used for vertical rescues as the wearer could potentially slip out of the harness in such a situation.

Referring to FIG. 1, shoulder strap 14 is preferably made from one continuous piece of webbing that is attached to waist strap 12 at distal ends 16 and 18, and further secured to back strap 20 generally at an apex of the looping arrangement of shoulder strap 14, which is located behind the wear's neck when worn, as shown in FIGS. 2 and 4. Shoulder strap 14 can be portioned into a left shoulder strap 30 and a right shoulder strap 32 for clarification. Further referring to FIG. 2, when worn, shoulder straps 30 and 32 are located on the front of the wearer and single back strap 20 is located in the middle of the wearer's back so that back strap 20 supports the wearer's back when being dragged.

Preferably, each side of shoulder strap 14 is folded in thirds, towards the middle of the webbing and then sewn down. This creates a narrowed portion 35, disposed preferably around the neck area of the wearer for preventing rubbing on the wearer's neck and providing added comfort. This narrowed portion also help the wearer distinguish the front of the harness from the back.

The handle system of body harness 10 preferably includes a pair of elongated drag straps 22 carried adjacent each other on distal end 34 of back strap 20, wherein each of drag straps 22 includes a hand grip 24 for added grip. Alternatively, a single drag strap could be used, but the dual strap arrangement allow the option of two rescuers to drag an injured person very quickly. As best shown in FIG. 1, the width of each of drag straps 22 is approximately half the width of back strap 20. Thus, in the preferred embodiment, back strap 20 is made using 2" nylon webbing, and drag straps 22 are made using 1" nylon webbing.

Referring to FIGS. 2 and 3, back strap 20 is preferably constructed to include a first strap layer 36 and a second strap layer 38 arranged in an overlapping manner to provide reinforced strength and support. As shown in FIG. 2, in this arrangement, waist strap 12 is disposed between first and second strap layers 36 and 38 generally at a first distal end 21*a* of back strap 20. Further, referring to FIG. 3, elongated drag straps 22 include securing portions, designated generally as 52, secured between first and second layers 36 and 38 of back strap 20 generally at a second distal end 34 of back strap 20. The layers are box-stitched together to prevent separation under force. Preferably, elongated drag straps 22 are constructed and arranged in a loop so that a first distal end 22*a* and a second distal end 22*b* of each drag strap is overlapped and secured between first and second layers 36 and 38 said back strap 20 at distal end 34. In this arrangement, drag straps 22 are carried on back strap 20 without extending laterally beyond the width of back strap 20.

Referring to FIG. 1, hand grips 24 are preferably provided as a hollow generally cylindrical shape. In this arrangement, elongated drag straps 22 extends through the hollow hand grip core so handle 24 cannot be removed once the elements are stitched together.

Referring to FIGS. 1-3, harness 10 includes a securing flap 44 formed from or carried by back strap 20 having a free end 46 operable between an engaged condition (FIG. 2 and FIG. 3) secured against back strap 20 holding hand grips 24 and elongated drag straps 22 in a stored position generally adjacent the intersection of back strap 20 and shoulder strap 14. As shown in FIG. 1, securing flap 44 also has a released condition wherein free end 46 is disengaged from back strap 20 allowing drag straps 22 and hand grips 24 to extend to a deployed position for dragging the wearer and increasing leverage.

Referring to FIG. 3, in the preferred embodiment illustrated, securing flap 44 is integrally formed from an extension of first layer 36 of back strap 20 adjacent shoulder strap 14. Securing flap 44 preferably includes a quick-release connector having a first securing member 48 carried by free end 46 of securing flap 44, and a second complementary securing member 50 carried on second layer 38 of back strap 20 for cooperating with first securing member 48 to hold the securing flap against the back strap and allowing for rapid release and deployment of the elongated drag straps. Preferably, securing members 48 and 50 are hook and loop connectors.

In summary, body harness 10 is designed for linear personnel recovery drags that decrease rescue time on the "X" by providing exponentially faster dragging ability with less physical exertion while keeps the injured person's profile as low as possible to decrease the likelihood of additional injuries. By sliding under existing protective wear, body harness 10 eliminates "ride up" associated with other built-in drag harnesses and techniques. Body harness 10 is designed to allow the rescuer to maintain engagement with the threat and promote and utilize improved body mechanics (maintain an anatomically correct posture) to rapidly extract larger weight personnel in the most efficient dragging manner available while maintaining threat engagement. Further, harness 10 allows the rescuer to maintain natural postures and positions that preclude shifting of personal protective equipment (PPE) that either obviates that equipment or exposes additional unprotected body regions. Finally, the harness simply decrease the manpower needs to rapidly extract an injured person from a zeroed in location, allowing other members of the squad that would normally be required to carry the injured person to safety instead to provide fire support during the extraction to increase the chances of a successful rescue.

While a preferred embodiment of the invention has been described using specific terms, such description is for illustrative purposes only, and it is to be understood that changes and variations may be made without departing from the spirit or scope of the following claims.

What is claimed is:

1. A body harness for dragging a person from a hostile environment, said harness comprising:

an adjustable waist strap;

a shoulder strap having a first distal end affixed to a right side of said waist strap and a second distal end affixed to a left side of said waist strap generally opposite from said first distal end so that said shoulder strap is carried by said waist strap in a looping arrangement;

a back strap affixed between said waist strap and shoulder strap, wherein said back strap extends approximately between a midpoint of said waist strap and a midpoint of said shoulder strap for supporting the back of the user when being dragged;

an elongated drag strap carried by said back strap and disposed generally at the intersection of said back strap and said shoulder strap for extending to facilitate dragging of the user; and, a hand grip carried by said drag strap for increased grip.

2. The body harness of claim 1 including a first elongated drag strap and a second elongated drag strap carried adjacent each other on said back strap, wherein each of said drag straps includes said hand grip.

3. The body harness of claim 2 wherein widths of each said first and second drag straps are approximately half the width of said back strap.

4. The body harness of claim 1 wherein said back strap includes a first strap layer and a second strap layer arranged in an overlapping manner so that said waist strap is disposed between said first and second strap layers generally at a first distal end of said back strap, and said elongated drag strap is secured between said first and second layers generally at a second distal end of said back strap.

5. The body harness of claim 4 wherein said elongated drag strap is constructed and arranged in a loop so that a first distal end and a second distal end of said drag strap are secured between said first and second layers of said back strap.

6. The body harness of claim 5 wherein said hand grip includes a hollow generally cylindrical shape, and wherein said elongated drag strap extends through said hand grip.

7. The body harness of claim 1 including a securing flap carried by said back strap having a free end operable between an engaged condition secured against said back strap holding said hand grip and said elongated drag strap in a stored position generally adjacent the intersection of said back strap and said shoulder strap, and said securing flap having a released condition wherein said free end is disengaged from said back strap allowing said drag strap and hand grip to extend to a deployed position.

8. The body harness of claim 7 including a quick-release connector coupling said free end of said securing flap to said back strap so that said securing flap may be rapidly released for deploying said elongated drag strap.

9. The body harness of claim 8 wherein said securing flap is integrally formed from an extension of said back strap adjacent the intersection of said shoulder strap and said back strap.

10. A body harness for dragging a person from a hostile environment, said harness comprising:

an adjustable waist strap;

a shoulder strap having first and second distal ends each generally secured to an opposing side of said waist strap;

a back strap extending generally between a midpoint of said waist strap and a midpoint of said shoulder strap for supporting the back of the user when being dragged;

an elongated drag strap carried by said back strap disposed generally at the intersection of said back strap and said shoulder strap for extending to facilitate dragging of the user;

a hand grip carried by said drag strap for increased grip; and, a securing flap carried by said back strap having a free end operable between an engaged condition secured against said back strap holding said elongated drag strap in a stored position, and a released condition wherein said free end is disengaged from said back strap allowing said drag strap to extend to a deployed position for dragging the user.

11. The body harness of claim 10 including a quick-release connector coupling said free end of said securing flap to said back strap so that said securing flap may be rapidly released for deploying said elongated drag strap.

12. The body harness of claim 11 including a first elongated drag strap and a second elongated drag strap carried adjacent each other on said back strap.

13. The body harness of claim 12 wherein widths of each said first and second drag straps are approximately half the width of said back strap.

14. The body harness of claim 13 wherein said back strap includes a first strap layer and a second strap layer arranged in an overlapping manner so that said waist strap is disposed between said first and second strap layers generally at a first distal end of said back strap, and said elongated drag strap is secured between said first and second layers generally at a second distal end of said back strap.

15. The body harness of claim 14 wherein said securing flap is integrally formed from an extension of said second layer of said back strap adjacent said shoulder strap.

16. The body harness of claim 15 wherein said quick-release connector includes a first securing member carried by said free end of said securing flap, and a second complementary securing member is carried by said first layer of said back strap for cooperating with said first securing member to hold said securing flap against said back strap.

17. The body harness of claim 16 wherein said elongated drag strap is constructed and arranged in a loop so that a first distal end and a second distal end of said drag strap are secured between said first and second layers of said back strap.

18. The body harness of claim 17 wherein said hand grip includes a hollow generally cylindrical shape, and wherein said elongated drag strap extends through said hand grip.

* * * * *